US008245746B2

(12) United States Patent
Stanczak

(10) Patent No.: US 8,245,746 B2
(45) Date of Patent: Aug. 21, 2012

(54) TIRE INFLATION SYSTEM WITH PRESSURE LIMITER

(75) Inventor: Edmund A. Stanczak, St. Clair Shores, MI (US)

(73) Assignee: ArvinMeritor Technology, LLC, Troy, MI (US)

( * ) Notice: Subject to any disclaimer, the term of this patent is extended or adjusted under 35 U.S.C. 154(b) by 2595 days.

(21) Appl. No.: 10/895,717

(22) Filed: Jul. 21, 2004

(65) Prior Publication Data

US 2006/0018766 A1 Jan. 26, 2006

(51) Int. Cl.
*B60C 23/10* (2006.01)

(52) U.S. Cl. ..... 152/415; 152/417

(58) Field of Classification Search ..... 152/415–417
See application file for complete search history.

(56) References Cited

U.S. PATENT DOCUMENTS

| | | | | |
|---|---|---|---|---|
| 4,387,931 | A * | 6/1983 | Bland | 152/416 |
| 4,498,709 | A | 2/1985 | Wells | |
| 4,733,707 | A | 3/1988 | Goodell | |
| 4,765,383 | A * | 8/1988 | Bott | 152/416 |
| 4,883,106 | A | 11/1989 | Schultz | |
| 4,932,451 | A | 6/1990 | Williams | |
| 5,203,391 | A | 4/1993 | Fox | |
| 5,287,906 | A | 2/1994 | Stech | |
| 5,377,736 | A | 1/1995 | Stech | |
| 5,429,167 | A | 7/1995 | Jensen | |
| 5,538,062 | A | 7/1996 | Stech | |
| 5,584,949 | A | 12/1996 | Ingram | |
| 5,587,698 | A | 12/1996 | Genna | |
| 5,629,874 | A * | 5/1997 | Mittal | 152/416 |
| 5,769,979 | A | 6/1998 | Naedler | |
| 5,979,526 | A | 11/1999 | Chamoy | |
| 6,105,645 | A | 8/2000 | Ingram | |
| 6,145,559 | A | 11/2000 | Ingram | |
| 6,260,595 | B1 | 7/2001 | Cobb | |

FOREIGN PATENT DOCUMENTS

| | | |
|---|---|---|
| DE | 2612332 | 10/1976 |
| DE | 3619603 | 1/1987 |
| GB | 492510 | 9/1938 |
| GB | 2178705 | 2/1987 |
| WO | WO9216384 | 10/1992 |
| WO | WO96/24498 | 8/1996 |
| WO | WO0102196 | 1/2001 |

* cited by examiner

*Primary Examiner* — Jason Bellinger
(74) *Attorney, Agent, or Firm* — Carlson, Gaskey & Olds, PC

(57) ABSTRACT

A tire inflation system includes a hose that connects to a tire via a valve stem. A control valve is in fluid communication with the hose and senses when pressure falls below a predetermined minimum value. When this occurs, the control valve automatically opens to re-supply air to the tire until the predetermined minimum value is achieved. A pressure relieve valve is also in fluid communication with the hose. If, for example, ambient temperatures increase, causing tire pressure to increase, then the pressure relief valve automatically vents excessive pressure to atmosphere. The pressure relief valve is set at a predetermined maximum pressure level that is generally at least 5 psi more than the predetermined minimum value.

20 Claims, 2 Drawing Sheets

TIRE INFLATION SYSTEM WITH PRESSURE LIMITER

TECHNICAL FIELD

The subject invention relates to a tire inflation system including a pressure relief valve for each tire that automatically vents excessive pressure to atmosphere.

BACKGROUND OF THE INVENTION

Tire inflation systems are used on vehicles, such as a tractor-trailer vehicle, to maintain tire inflation pressures at a desired tire pressure setting. The tire inflation system draws pressurized air from on-board air tanks that also supply pressurized air to other vehicle systems, such as brake and suspension systems. The tire inflation system includes a control that automatically supplies air from one of the on-board air tanks to an under-inflated tire when tire pressure falls below the desired tire pressure setting.

Tire pressures can change during vehicle operation for many different reasons. The tire could have a slow leak caused by an embedded nail or a small puncture. Tire pressure can also change in response to changes in ambient temperature. Increasing the ambient temperature increases tire pressure and decreasing the ambient temperature decreases tire pressure.

For example, assume a tractor-trailer starts out in Florida, where the ambient temperature is 100° F., and drives to Minnesota where the ambient temperature is 0° F. This 100 degree decrease in ambient temperature will cause an approximate 20 psi decrease in tire pressure. In this situation, the tire inflation system will add air to the tires in response to the change in temperature as it would if there were a tire leak caused by a nail.

However, if the tractor-trailer starts out in Minnesota where the ambient temperature is 0° F., and drives to Florida, where the ambient temperature is 100° F., the tire inflation system does not typically respond accordingly. The 100 degree increase in ambient temperature will cause an approximate 20 psi increase in tire pressure. Traditionally, tire inflation systems, such as those used on commercial tractor-trailer vehicles, do not have a way of deflating over-inflated tires. Thus, the tire inflation system does not react when the tires are pressurized higher than the desired tire pressure setting and a vehicle operator may think that the tire inflation system is not operating properly.

It would be beneficial to provide a tire inflation system with a simple and effective way to control excessive tire pressure in addition to maintaining tire pressure at a desired tire pressure setting.

SUMMARY OF THE INVENTION

A tire inflation system includes a pressure line that is connected to a tire through a valve stem. The pressure line and the tire are effectively maintained at a common pressure. A control valve is in fluid communication upstream with a fluid supply and is in fluid communication downstream with the pressure line. The control valve senses when tire pressure falls below a desired pressure setting and automatically opens to allow pressurized fluid from the fluid supply to bring pressure in the tire back up to the desired pressure setting. A pressure relief valve is also in fluid communication with the pressure line. The pressure relief valve automatically vents to atmosphere when tire pressure exceeds a maximum pressure setting. This prevents the tire from experiencing excessive pressures in response to changes in ambient temperatures.

In one example, the maximum pressure setting is at least 5 psi greater than the desired pressure setting. This prevents the control valve and pressure relief valve from constantly cycling around a single tire pressure setting. This also prevents pressure from venting due to an approximately 5 psi pressure increase normally associated with increase in tire temperature due to over road operations.

Preferably, each tire that is coupled to the tire inflation system has a separate pressure line connection. In this configuration, each pressure line connection has a pressure relief valve. In other words, each tire has its own pressure relief valve. All of the pressure relieve valves operate independently from each other. Thus, if only one tire is over-inflated, only the pressure relief valve at that tire is activated.

Incorporating a pressure relief valve into a pressure line connection for a tire is a simple and cost effective way to prevent tires from operating at excessive pressures. These and other features of the present invention can be best understood from the following specification and drawings, the following of which is a brief description.

DETAILED DESCRIPTION OF THE PREFERRED EMBODIMENT

Figure 1:
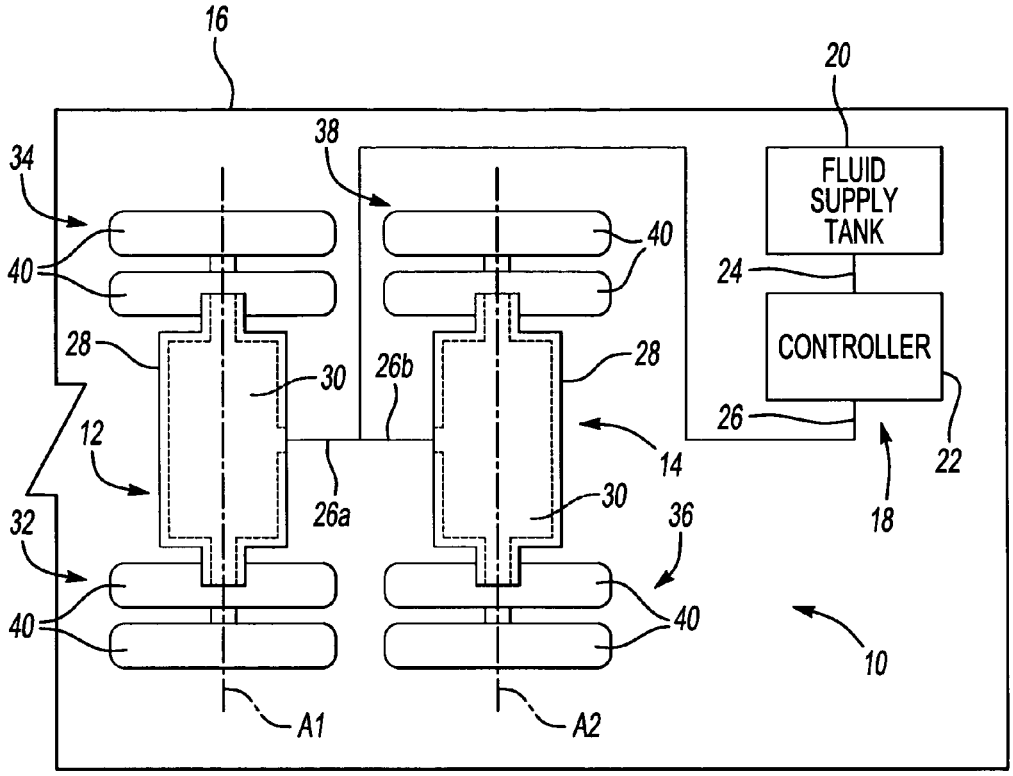
FIG. 1 is a schematic overhead view of a trailer axle assembly with a tire inflation system incorporating the subject invention.

A trailer axle assembly 10 is shown in FIG. 1. The trailer axle assembly 10 includes a first non-drive axle 12 and a second non-drive axle 14 that are typically positioned near a rear end portion of a trailer 16. A front end of the trailer 16 is typically supported on a tractor structure (not shown) as is known in the art. While only two non-drive axles are shown, it should be under stood that additional or fewer non-drive axles could be used to support the trailer 16.

A tire inflation system 18 includes a fluid supply tank 20, a controller 22 in fluid communication with the fluid supply tank 20 via a first connection 24, and a second connection 26 that extends to the first 12 and second 14 non-drive axles. While the tire inflation system 18 is shown as being used on a non-drive trailer axle, it should be understood that the tire inflation system 18 could also be used for drive or non-drive axles for a tractor or other similar vehicle. Further, the fluid supply tank 20 is preferably an air tank that is used for the trailer brake and/or suspension system. Optionally, a separate fluid supply tank could be included on the trailer 16.

The first 12 and second 14 non-drive axles each include an axle housing 28 that defines a sealed inner cavity 30. The second connection 26 includes a first portion **26*a* that is in fluid communication with the sealed inner cavity 30 of the first non-drive axle 12 and a second portion 26*b* that is in fluid communication with the sealed inner cavity 30 of the second non-drive axle 14**.

The first non-drive axle 12 defines a first lateral axis of rotation A1, and includes a first set of wheels 32 positioned at one end of the axle housing 28 and a second set of wheels 34 laterally spaced from the first set of wheels 32 at an opposite end of the axle housing 28. The second non-drive axle 14 defines a second lateral axis of rotation A2, and includes a first set of wheels 36 positioned at one end of the axle housing 28 and a second set of wheels 38 laterally spaced from the first set of wheels 36 at an opposite end of the axle housing 28. Each of the first 32, 36 and second 34, 38 sets of wheels includes either one (1) or two (2) tires 40. The tire inflation system 18 is in fluid communication with each of the tires 40.

Figure 2:
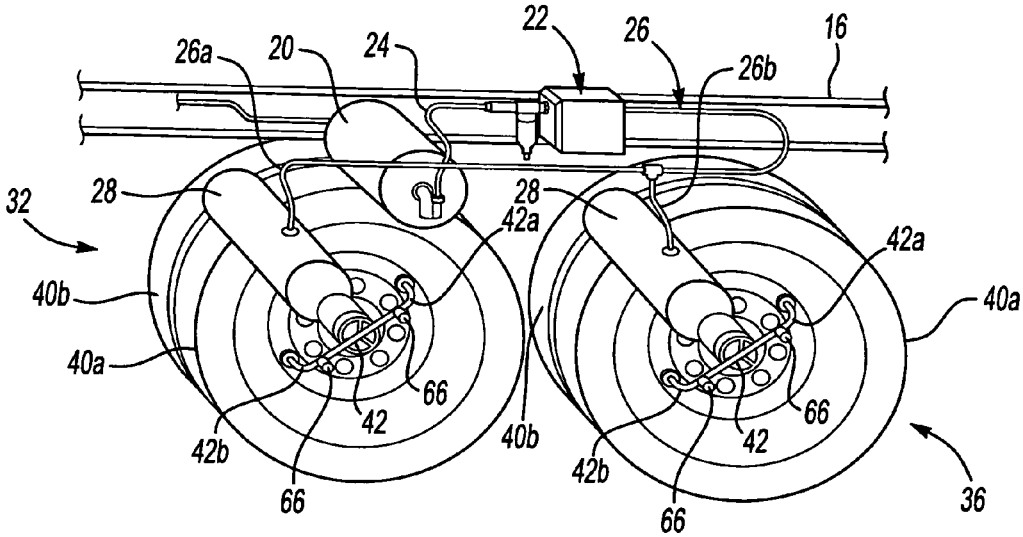
FIG. 2 is a perspective view of one side of the trailer axle assembly of FIG. 1.

As shown in greater detail in FIG. 2, a third connection 42 is in fluid communication with each axle housing 28 and extends outboard of the first sets of wheels 32, 36. The third connection 42 is in fluid communication with the tires 40. In the example shown in FIGS. 1 and 2, the first sets of wheels 32, 36 each include a pair of tires 40, i.e. each first set of wheels 32, 36 includes a first tire 40*a* and a second tire 40*b*. The third connection 42 includes a first portion 42*a* that is in fluid communication with the first tire 40*a* and a second portion 42*b* that is in fluid communication with the second tire 40*b*. While only the first sets of wheels 32, 36 are shown in FIG. 2, it should be understood that the second sets of wheels 34, 38 are configured in a similar manner.

Each of the first 24, second 26, and third 42 connections is comprised of a pressurized line or hose assembly as is known in the art. The pressurized lines and/or hose assemblies can be rigid members, flexible members, or can be a combination of rigid and flexible members.

Figure 3:
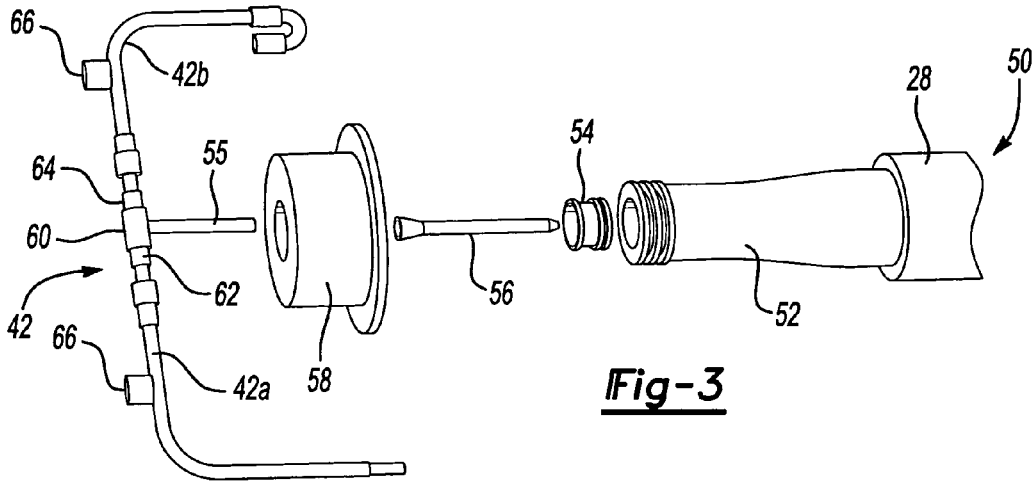
FIG. 3 is an exploded view of a wheel-end assembly with the tire inflation system incorporating the subject invention.

An example of a wheel end assembly 50 is shown in FIG. 3. The wheel ends assembly 50 is similarly configured for each of the first 32, 36 and second 34, 38 sets of wheels. The wheel end assembly 50 includes a non-rotating spindle 52 that is either attached to or integrally formed with the axle housing 28. A press plug 54 is inserted into one end of the non-rotating spindle 52. A stator 56 is inserted into the press plug 54 and is in fluid communication with the sealed inner cavity 30 of the axle housing 28. The stator 56 is a hollow tube that is fixed to the non-rotating spindle 52 and press plug 54. Appropriate seal assemblies (not shown) are incorporated into the press plug 54, stator 56, and/or hubcap 58 as known.

A tee-connection 60 is in fluid communication downstream with the stator 56 via a connecting tube 55, and is in fluid communication upstream with the third connection 42. A first arm 62 of the tee-connection 60 is in fluid communication with the first portion 42*a* and a second arm 64 is in fluid communication with the second portion 42*b*. The first 42*a* and second 42*b* portions are respectively in fluid communication with the first 40*a* and second 40*b* tires via valve stem assemblies (not shown).

A pressure relief valve 66 is in fluid communication with each of the first 42*a* and second 42*b* portions of the third connection 42. Any type of pressure relief valve 66 known in the art could be used. The pressure relief valve 66 automatically vents pressurized fluid to atmosphere under predetermined conditions. The operation of the pressure relief valve 66 will be discussed in greater detail below.

Figure 4:
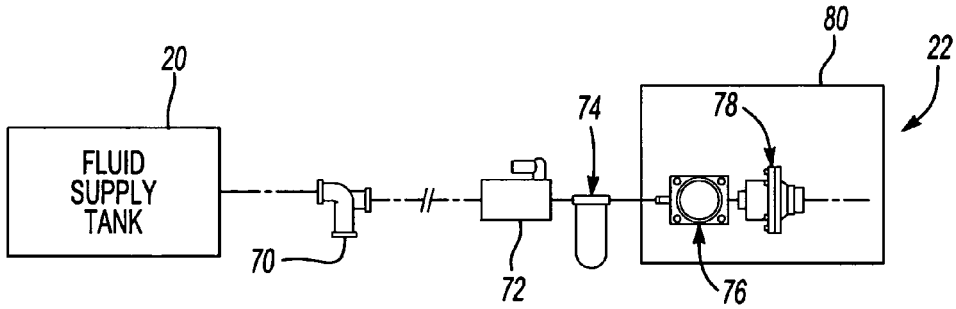
FIG. 4 is a schematic view of a control system for the tire inflation system.

The controller 22 is shown in greater detail in FIG. 4. The controller 22 includes a pressure protective valve 70, a shut-off valve 72, a filter 74, a control valve 76, and a flow-sensing switch 78. The control valve 76 and flow-sensing switch 78 are preferably enclosed within a control box or housing 80. The pressure protection valve 70 is located upstream of the control valve 76, near the fluid supply tank 20. The pressure protection valve 70 prevents system pressure in the fluid supply tank 20 from falling below a predetermined minimum system pressure. Typically, the pressure protection valve 70 is set at a pressure of around 80 psi while pressure in the fluid supply tank 20 is generally at a pressure of 130 psi. If one of the tires 40 experiences a blow-out or if one of the pressurized lines in the tire inflation system 18 is cut or somehow unsealed, the pressure protection valve 70 will automatically activate to prevent further fluid from being supplied to the damaged component once pressure falls below 80 psi.

The shut-off valve 72 allows a vehicle operator to shut off the tire inflation system 18. This allows the vehicle operator to perform service and maintenance operations. The filter 74 prevents contaminants from entering the control valve 76 and other downstream components.

The control valve 76 automatically activates to open fluid communication between the fluid supply tank 20 and the second connection 26 when pressure in any one of the first 42*a* or second 42*b* portions of the third connection 42 falls below a desired minimum pressure. Typically, a desired minimum pressure for each of the tires 40 is around 100 psi. When the first 42*a* and second 42*b* portions are connected to valve stem assemblies of the first 40*a* and second 40*b* tires, respectively, the first 42*a* and second 42*b* portions become part of the first 40*a* and second 40*b* tires. In other words, the first tire 40*a* and the first portion 42*a* are in constant fluid communication and are approximately maintained at a common fluid pressure, and the second tire 40*b* and the second portion 42*b* are in constant fluid communication and are approximately maintained at a common fluid pressure. Further, the first 40*a* and second 40*b* tires are maintained at a common fluid pressure with each other. Thus, if either of the first 42*a* or second 42*b* portions of the third connection 42 is cut or punctured, the respective first 40*a* or second 40*b* tire will deflate.

However, fluid pressure in each of the first 40*a* and second 40*b* tires is maintained separately. If the first portion 42*a* of the third connection 42 is punctured, only the first tire 40*a* will deflate. The second portion 42*a* and second tire 40*b* will remain pressurized.

All system pressure downstream of the control valve 76 is maintained at a common pressure. Thus, the sealed inner cavities 30, the second connection 26, the third connection 42, and the tires 40 are all at a common pressure. If the desired minimum pressure is set at 100 psi, then all of these components are at 100 psi. The control valve 76 senses when pressure falls below 100 psi. Thus, if any one of the tires 40 has a slow leak or an embedded nail, for example, the control valve 76 will sense the pressure drop and will automatically open to re-supply the under-inflated tire with fluid. Any type of control valve 76 known in the art could be used.

When the tire inflation system 18 is active, i.e. when the control valve 76 is open and a tire is being re-supplied with fluid, the flow-sensing switch 78 senses fluid flow and generates a signal that is communicated to the vehicle operator. The signal can be used to activate a warning lamp or display in a vehicle cab to inform the vehicle operator that the tire inflation system 18 is active. If the warning lamp repeatedly comes on or is continuously on, the vehicle operator can determine whether additional tire maintenance is required.

If tire pressure exceeds a maximum pressure threshold, the pressure relief valves 66 automatically vent excessive pressure to atmosphere. This prevents tires 40 from operating at excessive tire pressures. Each tire 40 has its own pressure relief valve 66. Preferably, the pressure relief valves 66 are set to vent at a pressure approximately 5 psi greater than a desired minimum pressure. Thus, if the desired minimum pressure were 100 psi then the pressure relief valves 66 would be set at 105 psi. The difference of 5 psi is required to prevent the tire inflation system 18 and pressure relief valve 66 from "fighting" each other and constantly cycling around a single tire pressure setting. Also, the difference prevents the pressure relief valve 66 from venting air from the tire during the approximately 5 psi increase in tire pressure normally associated with the increase in tire temperature due to over the road operations.

Tire pressure could increase for many different reasons. For example, changes in ambient temperature affect tire pressures. In a first example, a trailer fitted with a tire inflation system is located in Minnesota where in the winter a typical ambient temperature could be 0° F. The trailer is then hauled to Florida where the temperature is 100° F. This 100 degree increase in temperature will cause an approximate 20 degrees increase in tire pressure. The pressure relief valve 66 senses when a tire pressure exceeds a maximum threshold pressure and automatically vents excessive pressure to the atmosphere.

The reverse situation is also accommodated by the tire inflation system 18. In this example, a trailer fitted with a tire inflation system is located in Florida where the temperature is 100° F. The trailer is then hauled to Minnesota where the ambient temperature is 0° F. This 100 degree decrease in temperature will cause an approximate 20 degrees decrease in tire pressure. The control valve 76 senses the drop in pressure and automatically re-inflates the tires 40 to the desired level.

Thus, the subject tire inflation system 18 automatically addresses both increases and decreases in ambient temperature to maintain tire pressure levels at a desired pressure. It should be understood that the tire inflation system 18 shown in FIGS. 1-4 is just one example of a tire inflation system, and that tire inflation systems can have other configurations. The subject invention of using the pressure relief valves 66 to automatically vent excessive pressure in response to increases in ambient temperature can be used in any tire inflation system configuration.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A tire inflation system comprising:

a pressure line connectable to a tire;

a control valve in fluid communication with a fluid supply wherein said control valve is operable to automatically maintain said pressure line at a desired minimum pressure; and a pressure relief valve in fluid communication with said pressure line, said pressure relief valve automatically venting to atmosphere when pressure in said pressure line exceeds a maximum threshold pressure.

2. The tire inflation system according to claim 1 wherein said pressure relief valve is upstream from the tire and downstream from said control valve.

3. The tire inflation system according to claim 1 wherein said desired minimum pressure and said maximum threshold pressure have a difference of at least 5 psi.

4. The tire inflation system according to claim 3 wherein said desired minimum pressure is about 100 psi and said desired maximum pressure is about 105 psi.

5. The tire inflation system according to claim 1 wherein fluid pressure in the tire is always approximately equal to fluid pressure in said pressure line.

6. A tire inflation system comprising:

an axle extending between first and second wheels laterally spaced apart from each other and rotatable about an axis of rotation;

a hose assembly having a first hose member fluidly connectable with at least one first tire mountable for rotation with the first wheel and a second hose member fluidly connectable with at least one second tire mountable for rotation with the second wheel;

a control in fluid communication upstream with a fluid supply and in fluid communication downstream with said hose assembly, said control including a flow valve that automatically opens when fluid pressure in said hose assembly falls below a predetermined minimum pressure to maintain fluid pressure in the at least one first and second tires at said predetermined minimum pressure;

a first pressure relief valve assembly in fluid communication with said first hose member wherein said first pressure relief valve assembly automatically vents to atmosphere when fluid pressure in said first hose member exceeds a predetermined maximum pressure; and a second pressure relief valve assembly in fluid communication with said second hose member wherein said second pressure relief valve assembly automatically vents to atmosphere when fluid pressure in said second hose member exceeds said predetermined maximum pressure.

7. The tire inflation system according to claim 6 wherein said predetermined maximum pressure is approximately 5 psi greater than said predetermined minimum pressure.

8. The tire inflation system according to claim 6 wherein the at least one first tire comprises a pair of first tires with said first hose member including a first hose portion in fluid communication with one tire of the pair of first tires and a second hose portion in independent fluid communication with the other tire of the pair of first tires with said first pressure relief valve assembly including a first valve member in fluid communication with said first hose portion for automatically venting to atmosphere when fluid pressure in the one tire of the pair of first tires exceeds said predetermined maximum pressure and a second valve member in fluid communication with said second hose portion for automatically venting to atmosphere when fluid pressure in the other tire of the pair of first tires exceeds said predetermined maximum pressure.

9. The tire inflation system according to claim 8 wherein the at least one second tire comprises a pair of second tires with said second hose member including a third hose portion in fluid communication with one tire of the pair of second tires and a fourth hose portion in independent fluid communication with the other tire of the pair of second tires with said second pressure relief valve assembly including a third valve member in fluid communication with said third hose portion for automatically venting to atmosphere when fluid pressure in the one tire of the pair of second tires exceeds said predetermined maximum pressure and a fourth valve member in fluid communication with said fourth hose portion for automatically venting to atmosphere when fluid pressure in the other tire of the pair of second tires exceeds said predetermined maximum pressure.

10. The tire inflation system according to claim 9 wherein said first, said second, said third, and said fourth valve members operate independently from each other.

11. The tire inflation system according to claim 10 wherein fluid pressure in the pairs of first and second tires and fluid pressure in said first, said second, said third, and said fourth hose portions are all maintained within a 5 psi pressure range with each other.

12. The tire inflation system according to claim 6 including a pressure protection valve positioned upstream from said first and second pressure relief valve assemblies and set at a minimum supply pressure level such that said pressure protection valve prohibits said flow valve from supplying fluid from the fluid supply to the at least one first and second tires if fluid pressure downstream of said pressure protection valve falls below said minimum supply pressure level.

13. The tire inflation system according to claim 12 including a flow sensing switch that generates an indicator signal that is communicated to a vehicle operator when said flow valve is open.

14. The tire inflation system according to claim 12 wherein said axle includes a housing enclosing a cavity wherein said cavity is maintained at said predetermined minimum pressure.

15. The tire inflation system according to claim 14 wherein said first hose member has a first fluid pressure, said second hose member has a second fluid pressure, said cavity has a third fluid pressure, the at least one first tire has a fourth fluid pressure, and the at least one second tire has a fifth fluid pressure wherein said first, said second, said third, said fourth, and said fifth fluid pressures vary from each other by less than 5 psi.

16. The tire inflation system according to claim 1 wherein said pressure line is connectable to a plurality of tires, and wherein said pressure relief valve comprises a plurality of relief valves with one relief valve being associable with one tire such that said plurality of relief valves can operate independently of each other.

17. The tire inflation system according to claim 6 wherein said first pressure relief valve assembly and said second pressure relief valve assembly operate independent of each other.

18. A tire inflation system comprising:

a pressure line connectable to a plurality of tires;

a control valve in fluid communication with a fluid supply wherein said control valve is operable to automatically maintain said pressure line and each of the plurality of tires at a desired minimum pressure; and a plurality of pressure relief valves in fluid communication with said pressure line, with each of said plurality pressure relief valves being associable with one tire of the plurality of tires such that each pressure relief valve automatically vents to atmosphere when pressure in an associated one of the plurality of tires exceeds a maximum threshold pressure.

19. The tire inflation system according to claim 18 wherein said plurality of pressure relief valves comprise the only valves positioned downstream of said control valve and upstream of the plurality of tires.

20. The tire inflation system according to claim 18 including at least one axle to support the plurality of tires, said at least one axle including a sealed inner cavity that is downstream of said control valve, and wherein said sealed inner cavity is connected to said control valve with a first connection and is connectable to the plurality of tires with a second connection and wherein system pressure within said sealed inner cavity, within said first and said second connections, and within the plurality of tires is maintained at a generally common pressure.

* * * * *